US008109224B2

(12) United States Patent
Abdel-Maksoud et al.

(10) Patent No.: US 8,109,224 B2
(45) Date of Patent: Feb. 7, 2012

(54) SUBMARINE WITH UNDERWATER EXHAUST DISCHARGE DURING SNORKELING MODE

(75) Inventors: Moustafa Abdel-Maksoud, Berlin (DE); Rainer Hartig, Buxtehude (DE); Stefan Jungnitz, Uttenreuth/Weiher (DE); Hannes Schulze Horn, Gladbeck (DE)

(73) Assignee: Siemens Aktiengesellschaft, Munich (DE)

( * ) Notice: Subject to any disclaimer, the term of this patent is extended or adjusted under 35 U.S.C. 154(b) by 945 days.

(21) Appl. No.: 11/795,716

(22) PCT Filed: Jun. 13, 2005

(86) PCT No.: PCT/EP2005/052707

§ 371 (c)(1),
(2), (4) Date: Apr. 14, 2008

(87) PCT Pub. No.: WO2006/079421

PCT Pub. Date: Aug. 3, 2006

(65) Prior Publication Data

US 2011/0126752 A1 Jun. 2, 2011

(30) Foreign Application Priority Data

Jan. 25, 2005 (EP) ..... 05100461
Feb. 17, 2005 (DE) ..... 10 2005 007 484

(51) Int. Cl.
*B63G 8/08* (2006.01)

(52) U.S. Cl. ..... 114/337

(58) Field of Classification Search ..... 114/337
See application file for complete search history.

(56) References Cited

U.S. PATENT DOCUMENTS 4,631,032 A 12/1986 Nishida et al.
5,293,852 A * 3/1994 Lehner et al. ..... 123/339.18
2004/0200399 A1 10/2004 Moustafa

FOREIGN PATENT DOCUMENTS

DE 100 61 487 C1 3/2002
DE 102 24 013 A1 5/2002
DE 103 14 057 B3 3/2003
DE 103 18 293 A1 11/2004
FR 2 768 393 3/1999
FR 2 768 393 A 3/1999

OTHER PUBLICATIONS

PCT/ISA/220, Oct. 2005, Siemens.

* cited by examiner

*Primary Examiner* — Stephen Avila
(74) *Attorney, Agent, or Firm* — Harness, Dickey & Pierce, P.L.C.

(57) ABSTRACT

A submarine or surface watercraft is equipped with at least one, preferably supercharged charging diesel engine, which serves to charge the vessel's batteries and which is operated in a controlled and regulated manner during submarine snorkeling mode or during the normal operation of surface watercraft. In at least one embodiment, the exhaust gases produced during the operation of the charging diesel engine are mixed with a flow of water, which is drawn from the water surrounding the vessel and delivered in a regulated manner by a pump while interacting with a negative-pressure generating device, and, in a mixed state, are discharged under water. The operation of the formed negative-pressure generating and mixing device ensues while interacting with the controlling and regulating of the charging diesel engine.

35 Claims, 4 Drawing Sheets

SUBMARINE WITH UNDERWATER EXHAUST DISCHARGE DURING SNORKELING MODE

PRIORITY STATEMENT

This application is the national phase under 35 U.S.C. §371 of PCT International Application No. PCT/EP2005/052707 which has an International filing date of Jun. 13, 2005, which designated the United States of America and which claims priority on German Patent Application number 10 2005 007 484.7 filed Feb. 17, 2005 and on European Patent Application number EP 05100461 filed Jan. 25, 2005, the entire contents of each of which are hereby incorporated herein by reference.

BACKGROUND

When a submarine is snorkeling in order to charge the submarine batteries, the exhaust gases from the charging diesel must be removed from the submarine. For this purpose, it is known for an exhaust gas line to be provided in or adjacent to the snorkel mast, from which the exhaust gases emerge in such a manner that they do not mix with the fresh air being sucked in for the charging diesel. This has the disadvantage that an exhaust gas plume is created, which can be detected easily and reveals the presence of the submarine.

In order to avoid this disadvantage, it is known, for example from DE 103 14 057 B3, for the exhaust gases to actually be carried out in the head of the snorkel mast, which is still located underwater, at the same time reducing the water drag on the snorkel mast head in the process. In this case, the exhaust gas emerges without open-loop or closed-loop control through free cross sections in the casing tube of the exhaust gas snorkel mast head that is formed. This has the disadvantage that the exhaust gas snorkel mast has a large volume, with correspondingly high water drag. Furthermore, the mixing of the exhaust gas and water is not so fine that exhaust gas bubbles cannot rise to the surface of the water, where they form an exhaust-gas trail, which can give away the presence of the submarine. Furthermore, a certain amount of resistance to the exhaust gas outlet from the charging diesel must be overcome.

SUMMARY

At least one embodiment of the invention specifies a method and/or a device for a submarine, which reduces or even avoids at least one of the disadvantages mentioned above.

It is also known for submarines to be equipped with so-called power supplies that are independent of outside air, for example with circulating diesels.

It is known, for example from DE 100 61 487 C1, for these circulating diesels for the exhaust gases from the circulating diesels, which essentially contain only carbon dioxide, to be introduced with the aid of a porous body into a pipe, through which external water flows, on the submarine and to be emitted via the pipe.

The exhaust gases are in this case passed out of the circulating diesel at a level which is not inconsiderably below the water surface, and a pump is therefore provided in order to overcome the pressure of the external water. An output line such as this is suitable only for the small amounts of exhaust gas from a circulating diesel.

At least one embodiment of the invention specifies a submarine in which the exhaust gases of a conventional, in particular turbocharged, charging diesel for the submarine batteries when snorkeling can be emitted at a not inconsiderable water depth, and having been mixed very well with the surrounding water, without any loss of power or even with a gain in power, in the vicinity of the submarine hull. The details of the reduced-pressure production and mixing device which is required for the solution are known from the European patent application "Unterdruck-Mischeinrichtung für Schiffsabgas" [Reduced-pressure mixing device for marine vessel exhaust gas] (our reference: EP 05100461.2) which was not published with priority.

One refinement of at least one embodiment of the invention provides that the reduced-pressure production and mixing device is operated, in particular in an automated form, in conjunction with the submarine propulsion system and the submarine automation system. The inclusion of the reduced-pressure production and mixing device in the general submarine propulsion and automation system considerably improves security during operation of the submarine charging diesel with an underwater exhaust gas line. Independent operation is admittedly possible, for example if the water flow conveyed by pump control or a tapped-off flow from the cooling system of the charging diesel is first of all set to the maximum level, and with the exhaust gas being mixed in only after this has been done, although this can then result in an operating state which adversely affects the security of the submarine, in the event of faults.

Furthermore, better power optimization of the charging diesel is possible as a result of this inclusion.

A further refinement of at least one embodiment of the invention provides that the reduced-pressure production and mixing device is started in a starting sequence in conjunction with the charging diesel open-loop and closed-loop control, and that stopping and shutdown take place in a corresponding manner, in a stopping sequence. This ensures that the reduced-pressure production and mixing device is always operated in a predetermined starting and stopping mode, in particular at optimum speed and with optimum safety. Unsafe operating states can therefore be avoided with a high degree of confidence, and the operators can restrict themselves to monitoring correct operation of the starting and stopping of the charging diesel, and of its exhaust gas output line device.

In this context, at least one embodiment of the invention also provides that the reduced-pressure production and mixing device is started only after the water in the device has been blown out, with compressed air preferably being used to blow it out. The use of compressed air for blowing out the exhaust gas advantageously means that the paths for the exhaust gas are completely free, thus quickly achieving the higher efficiency of the turbocharger, and therefore of the charging diesel, that can be achieved as a result of the reduced pressure.

One advantageous embodiment of at least one embodiment of the invention provides that the reduced pressure in the reduced-pressure production and mixing device is set by way of a nominal value which is determined from the depth of the exhaust gas outlet opening under water, and in the process takes account in particular of the desired charging power in particular. This advantageously means that there is no need to carry out a reduced-pressure measurement in the reduced-pressure production and mixing device, since, because of the major vortices that occur there, this can be done only with difficulty and with a time delay. Running the reduced-pressure production and mixing device above a nominal value results in stable operation, which is also safer in particular when appropriate safety margins are applied, of the reduced-pressure production and mixing device.

In this case, at least one embodiment of the invention also provides that, during the formation of the nominal value, the submarine speed and possibly the density of the water surrounding the submarine are taken into account. This results in an improvement in the nominal value in the direction of the conditions which actually prevail in the reduced-pressure production and mixing device, in particular when the exhaust gas pressure from the internal combustion engine is taken into account when forming the reduced pressure. This then also makes it possible to set the reduced pressure such that maximum charging power, matched to the respective submersion depth, can be achieved.

It is likewise possible to match the closed-loop control to the power required the charging diesel, as a function of the water depth and the state of charge of the submarine batteries.

A further refinement of at least one embodiment of the invention provides that, for safe operation, an automatic non-return (safety) valve in the diesel exhaust gas line prevents seawater from flowing back into the exhaust gas line. If seawater flows back into the exhaust gas line, this can lead to considerable damage to the charging diesels. It is therefore advantageous to provide a separate safety device in this case, which responds independently in the event of possible failures of the open-loop and closed-loop control.

One refinement of at least one embodiment of the invention in this case provides that higher-level closed-loop pressure control, advantageously by way of a PID regulator, sets and maintains the reduced pressure in a control loop for the reduced pressure to be produced in the reduced-pressure production and mixing device, and sets and maintains the reduced pressure in a lower-level control loop for positioning a water inlet valve or for closed-loop control of the rotation speed of the water pump. This allows stable closed-loop control, corresponding to the requirements of a corresponding device, linking the various components to be controlled to one another. In this case, it is also possible to vary the flow cross section in the reduced-pressure production and mixing device under open-loop and closed-loop control.

This is particularly advantageous when using part of the flow from the charging diesel cooling water or when using other quantities of water originating from the submarine, instead of an amount of water from a separate pump. Closed-loop control by way of a separate valve or by cross-section variation is then advantageous, since no controllable-flow-separate pump is available.

In order to carry out the individual operating method steps for the exhaust gas line of a submarine charging diesel under water, a device is provided for open-loop and closed-loop operation of a reduced-pressure production and mixing device for the exhaust gases, which is connected to the submarine propulsion system, and in particular to the submarine automation system, for example to the part which is used for open-loop and closed-loop control of the charging diesel. The response of the exhaust gas output line device and of the charging diesel can thus be matched to one another at any time, taking account of the motion state of the submarine. The exhaust gas output line device can thus be set at any time, taking account of the submarine motion state, to the specific requirements of the charging diesel, and in this case in particular of the turbocharger.

The device for open-loop and closed-loop control operation of a reduced-pressure production and mixing device has, in particular, a higher-level control loop for closed-loop control of the reduced pressure and a lower-level control loop for closed-loop control of the pump rotation speed or of a valve in the propulsion water flow. This advantageously makes it possible to take account of the requirements for closed-loop control of the individual components, particularly when the closed-loop control comprises a PID regulator, which very quickly emits the required control variables.

In this case, at least one embodiment of the invention also provides that the device has a computation device for determining the outlet pressure of the gas-water mixture that is formed and/or the reduced pressure in the reduced-pressure production and mixing device. This computation unit, which is configured using the data for the reduced-pressure production and mixing device, very advantageously allows the internal pressure and the outlet pressure of the gas-water mixture formed to be calculated continuously. This allows safe closed-loop control of the reduced-pressure production and mixing device which safely not only takes account of the operation of the exhaust-gas turbocharger but also sets the required backpressure, while preventing the surrounding water from flowing into the device during operation. A controllable propulsion water pump or a control valve for the propulsion water, or else a nozzle whose cross section can be adapted, is optionally provided for the closed-loop control. In all cases, it is possible to provide safer open-loop and closed-loop control for the reduced pressure, so as to preclude any risk to the charging diesel.

Furthermore, at least one embodiment of the invention advantageously provides that the submarine has a compressed-air unit for the amount of freely blown air for the device. In this case, both an independent compressed-air unit and a unit which changes the exhaust gases, or air inducted through the snorkel, to the required blowing-out pressure, can be provided. This can then be supplied with the appropriate compressor power.

A further refinement of at least one embodiment of the invention provides that the submarine has a pressure sensor for the water pressure and, advantageously, a pressure sensor for the exhaust gas pressure upstream of the reduced-pressure production and mixing device. In a submarine, the water pressure is generally determined continuously by means of sensors, although in this case it is particularly advantageous to provide a specific, separate pressure sensor for the water pressure adjacent to or in the vicinity of the reduced-pressure production and mixing device. Together with a pressure sensor for the exhaust gas pressure upstream of the device, this then reliably produces the pressure difference which must be achieved by the device.

A further refinement of at least one embodiment of the invention provides that the submarine according to at least one embodiment of the invention has a computation unit for the procedure for a starting sequence and for a stopping sequence of the reduced-pressure production and mixing device. This allows safe starting and stopping operation. In this case, it is also possible to take account of environmental influences and the operating state of the charging diesel. The computation unit makes it possible to set the required setting variables particularly quickly, since a computation device such as this can react more quickly than the respective crewman. This is particularly important when the submarine has to dive quickly below snorkeling depth. In this case, provision is made for the computation device to be connected to the general submarine automation device and submarine propulsion system. This ensures the required operation of the reduced-pressure production and mixing device, as a function of the respective submarine maneuver.

At least one embodiment of the invention also provides that the computation unit is connected to the submarine state visualization, in particular to a control and observation station within the submarine automation system. This allows the crew to monitor the operation of the reduced-pressure production and mixing device easily and quickly at any time, in which case an existing screen, which is not required for any other purpose, can advantageously be used.

A reduced-pressure production and mixing device according to at least one embodiment of the invention can be used advantageously other than in submarines. Its use is also considerably advantageous in surface vessels with an underwater exhaust gas output line from power generating devices, in particular diesel generator sets or gas turbine generator sets, when the aim is to emit the exhaust gases considerably below the waterline. In this case, a water depth of 4 to 6 m can be achieved for the exhaust gas output line, so that it is virtually impossible to locate the exhaust gases, which are also swirled further in the wake of the surface vessel. The reduced-pressure production and mixing device is advantageously arranged in the area of the outer hull of the surface vessel, astern or amidships.

In the case of submarines, it is particularly advantageous to arrange the reduced-pressure production and mixing device at the foot of the sail, or behind the sail. Particularly in the case of submarines which are intended to be retrofitted, there is also advantageously no need to modify the exhaust gas routing within the submarine. All of the advantages are nevertheless achieved.

For surface vessels, it is particularly advantageous to use the reduced-pressure production and mixing device in conjunction with a deeply submerged waterjet, since the power generating device will be arranged in the vessel area in front of the waterjet for a deeply submerged waterjet, so that only short exhaust gas lines will be required, with the exhaust gases at the same time being mixed particularly well in the water. For horizontally operating position-finding appliances which operate in the IR band, this means that it will be impossible to locate the exhaust gases from the diesel or gas-turbine generator set for supplying deeply submerged waterjets.

BRIEF DESCRIPTION OF THE DRAWINGS

Example embodiments of the invention will be explained in more detail with reference to description below and the drawings, from which further details, which are also significant to example embodiments of the invention, will become evident, in the same way as from the dependent claims and the drawing description.

In detail.

DETAILED DESCRIPTION OF THE EXAMPLE EMBODIMENTS

Figure 1:
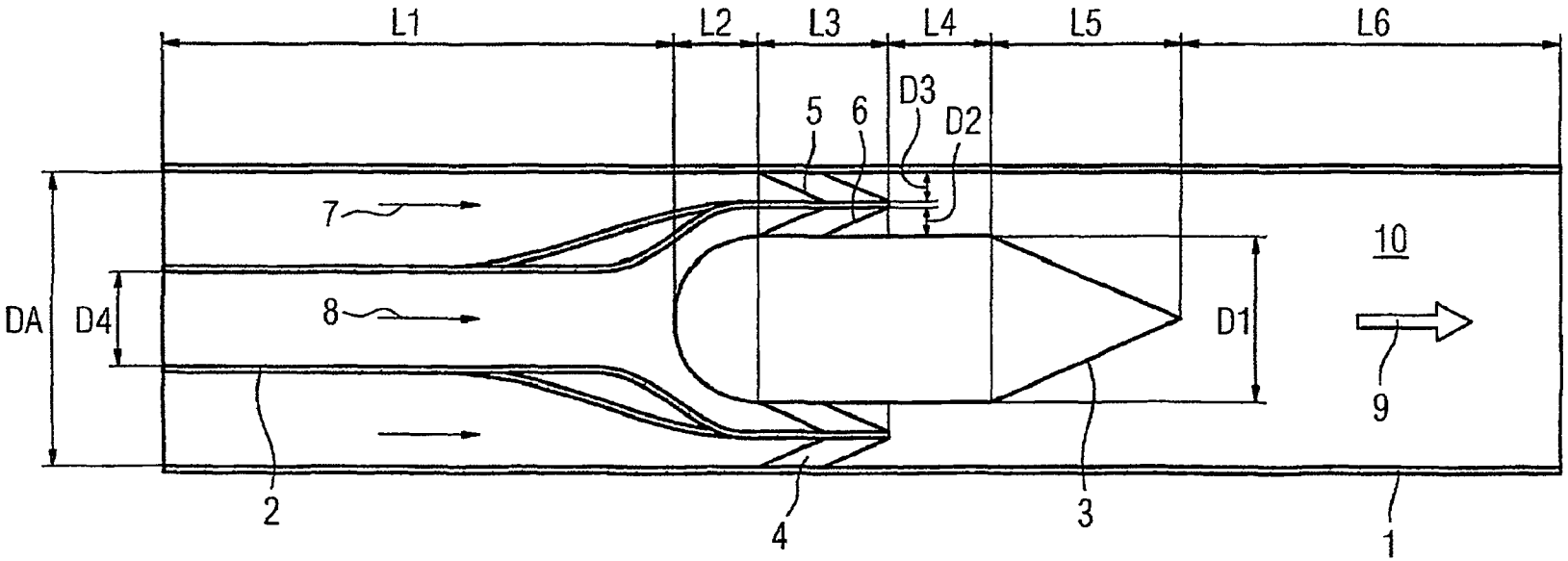
FIG. 1 shows a schematic section drawing through the device according to an embodiment of the invention.

In FIG. 1, 1 denotes the housing tube of the device which, at the same time, is the inlet tube for the mixing and reduced-pressure production (propulsion) water. 2 denotes the exhaust gas tube, and 3 the advantageous central displacement body, which is significant to an embodiment of the invention, for exhaust gas with an outlet cone for the mixture that is formed, with a diffuser effect. The reduced-pressure region according to the invention is formed around the displacement body 3 on the outside of the widened area 4. Guide elements 5 and 6 are provided in order to introduce spin into the water flow and into the gas flow, and at the same time said guide elements can form a holder for the displacement body 3 and for the widened water channel 4. The water fed to the mixing and reduced-pressure production device is symbolized by the arrows 7, and the exhaust gas is symbolized by the arrow 8. The gas-water mixture that is formed is symbolized by the double-headed arrow 9.10 denotes the mixture outlet tube. The guide elements 5 and 6 advantageously produce contrarotating spin.

One very major factor for the advantageous operation of the mixing and reduced-pressure production device is the geometric relationships, that is to say the tube diameter and tube section lengths in the device. For this reason, FIG. 1 shows the individual lengths and the major diameter. The ratios for the dimensions in FIG. 1 are as follows:

DA=1.5-2.0 D4
L1=3-4.5 D4
L2=0.6-0.8 D4
L3=0.8-1.2 D4
L4=0.6-1.0 D4
L5=1.3-1.7 D4
L6=1.5-3.5 D4
D1=1.2-1.5 D4
D2=0.2-0.3 D4
D3=0.2-0.3 D4

D4 is the diameter of the exhaust gas tube.

The relationships listed in the table have been calculated for an exhaust gas tube with a diameter of 250 mm, into which the exhaust gases from a typical, turbocharged diesel engine with a power of 1300 kW are introduced. The exhaust gas inlet temperature in the device is 90 degrees C., once it has been cooled according to an embodiment of the invention.

Figure 2:
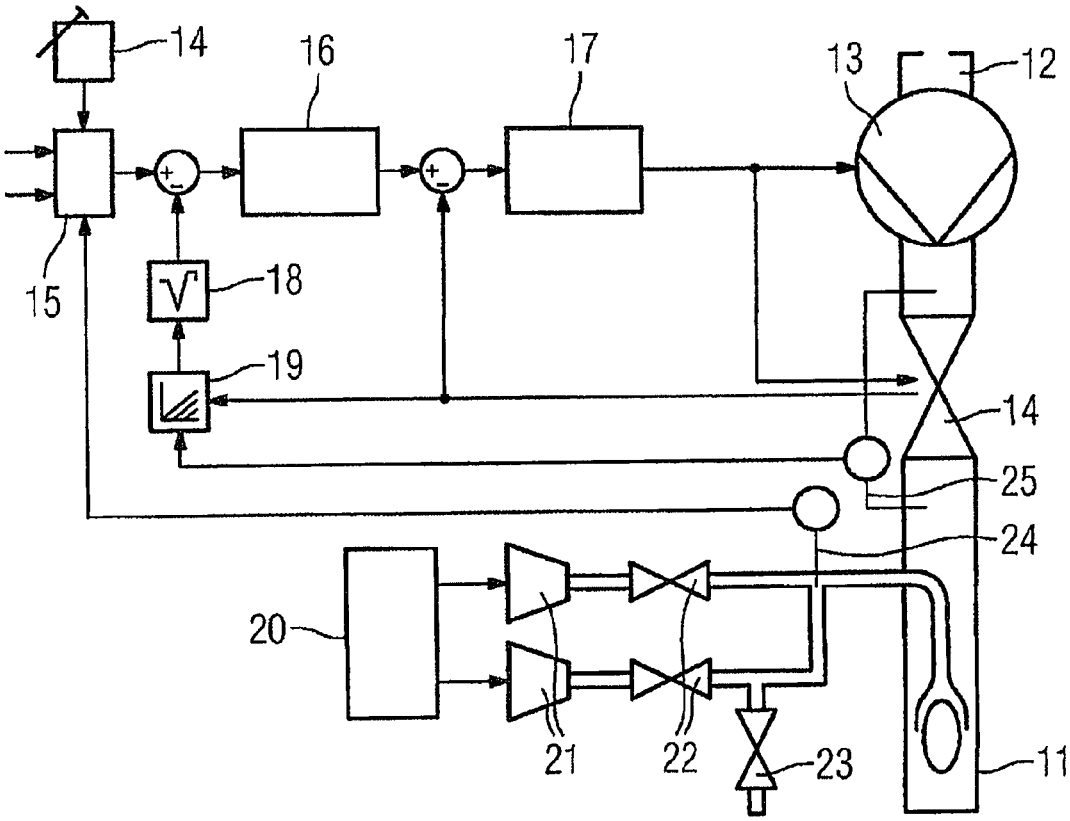
FIG. 2 shows a block diagram of the control system for the device according to an embodiment of the invention.

In FIG. 2, 11 denotes the reduced-pressure production and mixing device according to an embodiment of the invention in an abstracted form, while the other components of the closed-loop control system are illustrated in the normal electrical-engineering form. 12 denotes the seawater inlet and 13 the controllable pump which, if required, is followed by a control valve or a throttle valve 14. This control valve 14 can also be omitted if the dynamic response of the pump 13 is sufficiently good to ensure rapid dynamic closed-loop control, for example in order to compensate for wave peaks and troughs with heavy surf.

Element 14 denotes the input of the reduced-pressure nominal value and 15 the combination with the depth value and the relative speed value. The suction at the outlet of the exhaust gas/water mixture from the device according to an embodiment of the invention can be taken into account in the relative speed value. 16 and 17 denote a PID regulator and a PI regulator for pressure control, and the position control for the pump 13 or the valve 14. 18 denotes the magnitude (computation variable) of the reduced pressure, and 19 the amount of reduced-pressure water that is produced. The individual variables and input values are linked to one another in the normal control-engineering manner, with the closed-loop control system representing only one advantageous embodiment. 20 denotes the open-loop and closed-loop control unit for the two charging diesels 21 that are normally provided for the submarine, and 22 denotes the valves for the exhaust gas flow from the charging diesels. 23 denotes the inlet valve for the compressed air, which is used to blow the device 11 free before starting it up after having been submerged. 24 denotes the pressure measurement in the exhaust gas path and 25 the pressure difference across the control valve 14, which forms a basis for the calculations by the computation unit for the reduced pressure in the device 11. As can be seen, both the pressure in the exhaust gas line and the pressure difference, as well as the valve position, together with the depth and the relative speed, are used for control purposes.

Figure 3:
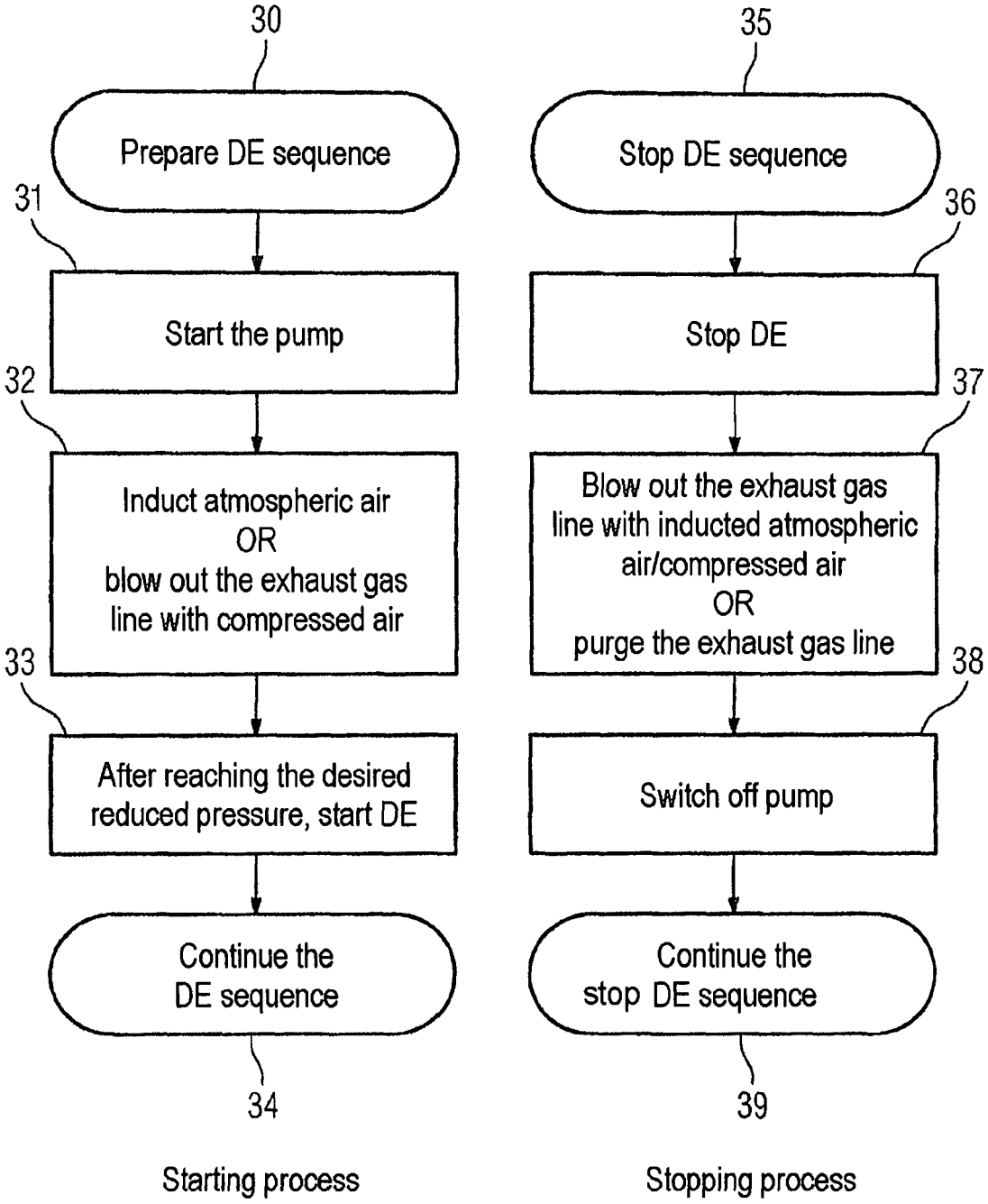
FIG. 3 shows a flowchart for the starting and stopping processes.

The individual blocks in the flowchart in FIG. 3, which shows the starting and stopping processes for the reduced-pressure production and mixing device show the tasks which have to be carried out in each block. The starting process is preceded by a preparation sequence 30 for the charging diesel. As is shown in block 31, the pump is started once this has been done. The exhaust gas line is then blown out with compressed air, in which case the compressed air can also be produced, as stated in 32, by means of air inducted through the snorkel, or by exhaust gas compression. The statement "blowing out with compressed air" relates to blowing out using compressed air from a compressed-air reservoir. As shown by 33, the blowing-out process is then followed by the respective diesel engine being started, which is followed by the normal running-up process for the diesel engine. This is symbolized by 34.

The stopping process starts with a sequence, symbolized by 35, of stopping the diesel engine, and this is carried out by the task in the block 36. Advantageously, as indicated in 37, the exhaust gas line is then blown out or purged. As can be seen from 38, the pump is then switched off, and the sequence continues with the diesel engine being stopped, symbolized by 39. This ensures correct operation of the reduced-pressure production and mixing device once again, in conjunction with and appropriately for the requirements for operating and for shutting down the charging diesels.

Figure 4:
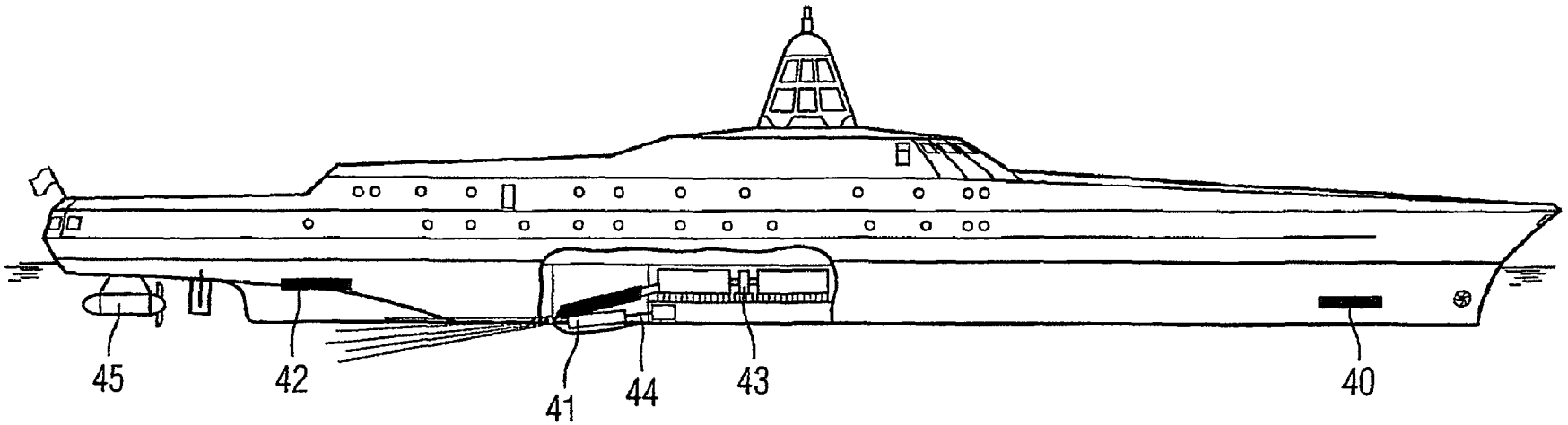
FIG. 4 shows an example, in the form of a schematic illustration, of a large oceangoing vessel, for example a frigate, with distributed devices according to an embodiment of the invention.

FIG. 4 shows a side view of a modern frigate with power generating sets distributed in the vessel, with 40 denoting an exhaust gas outlet, according to an embodiment of the invention, in the bow area of the vessel, 41 an exhaust gas outlet according to an embodiment of the invention amidships, which operates in conjunction with a waterjet 44 and an internal combustion engine generator set 43, while 42 denotes an outlet device, according to the invention, for exhaust gases in the stern area of the vessel. As can be seen, any power generating device which is arranged in the marine vessel, for example the frigate illustrated by way of example, although this may, of course, also be a corvette or a high-speed boat, can be equipped with a reduced-pressure production and exhaust-gas mixing appliance according to an embodiment of the invention.

The propulsion for the frigate shown in FIG. 4 is provided by an electrical steering propeller 45, although, of course, it can also be propelled by a propeller which is mounted in a fixed position in the stern of the marine vessel. This may either be a direct diesel drive or else a propeller drive driven by one or more electric motors. Depending on the magnitude of the exhaust gas flows, the devices 40, 41 or 42 according to an embodiment of the invention are then connected in parallel, since, for financial reasons, it is worthwhile restricting the device according to the invention to a standard size. The device according to an embodiment of the invention, whose control capabilities are appropriately designed, can then be appropriately configured and optimized. A correspondingly smaller device need be provided only for very small devices, for example for internal combustion engines of less than a few 100 kW, or for diesel reformers. However, the size of the device can be reduced without any changes relating to the flow.

The method and the device can be used whenever it is desired to increase the power of a diesel engine. The power of all diesel engines is dependent on the backpressure, and an embodiment of the invention makes it possible to considerably reduce the backpressure—even below atmospheric pressure.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A submarine, comprising:

at least one charging diesel, for at least one battery of the submarine, operated with open-loop and closed-loop control when snorkeling; and a reduced-pressure production and mixing device that operates in conjunction with the open-loop and closed-loop control of the at least one charging diesel, wherein exhaust gases produced during operation of the at least one charging diesel and a water flow taken from water surrounding the submarine and conveyed by pump control are mixed with one another, interact with a reduced-pressure production device, and are emitted in a mixed state under water.

2. The submarine as claimed in claim 1, wherein the reduced-pressure production and mixing device is operated in conjunction with a propulsion system and an automation system of the submarine.

3. The submarine as claimed in claim 1, wherein the reduced-pressure production and mixing device is started in a starting sequence in conjunction with the open-loop and closed-loop of the charging diesel.

4. The submarine as claimed in claim 1, wherein the reduced-pressure production and mixing device is shut down in a stopping sequence in conjunction with the open-loop and closed-loop of the charging diesel.

5. The submarine as claimed in claim 3, wherein the reduced-pressure production and mixing device is started only after the water in the device has been blown out using compressed air.

6. The submarine as claimed in claim 1, wherein reduced pressure in the reduced-pressure production and mixing device is set based on a nominal value, and the nominal value has a magnitude that is determined from a depth of an exhaust gas outlet of the submarine and a desired charging power, the exhaust gas outlet opening under water.

7. The submarine as claimed in claim 6, wherein the nominal value is determined based on a speed of the submarine and a density of the water surrounding the submarine.

8. The submarine as claimed in claim 6, further comprising an internal combustion engine, wherein the reduced pressure is determined based on an exhaust gas pressure of the internal combustion engine.

9. The submarine as claimed in claim 1, wherein the open-loop and closed-loop control operated in conjunction with the reduced-pressure production and mixing device are matched to a power required by the at least one charging diesel as a function of a depth of the water surrounding the submarine.

10. The submarine as claimed in claim 1, wherein the at least one charging diesel includes an exhaust gas line, and seawater is prevented from flowing back into the exhaust gas line by way of an automatic non-return valve in the exhaust gas line.

11. The submarine as claimed in claim 1, further comprising a PID regulator, wherein the at least one charging diesel is operated with higher-level closed-loop pressure control by way of the PID regulator, the higher-level closed-loop pressure control is set and maintained in a control loop for a reduced pressure to be produced, and the reduced pressure is set and maintained in a lower-level control loop for positioning a water inlet valve or a closed-loop control of a rotation speed of a water pump for the pump control.

12. The submarine as claimed in claim 1, wherein a flow cross section for the water in the reduced-pressure production and mixing device is subjected to the open-loop and closed-loop control in order to produce a reduced pressure.

13. The submarine as claimed in claim 1, further comprising a computation unit for at least one of a starting sequence and a stopping sequence, the computation unit being connected to at least one of a general submarine automation device and a propulsion system of the submarine.

14. The submarine as claimed in claim 1, further comprising a computation unit for operation of the reduced-pressure production and mixing device, which is connected to a control and observation station in the submarine.

15. A device for open-loop and closed-loop operation of the reduced-pressure production and mixing device that exhaust the exhaust gases from the at least one charging diesel of the submarine as claimed in claim 1, the submarine including a propulsion system and an automation system, the device comprising:

a controllable pump to produce a propulsion water flow by way of the reduced-pressure production and mixing device; and an electrical connection to transmit control variables and input values to the automation system, used for the open-loop and closed-loop control of the at least one charging diesel.

16. The device as claimed in claim 15, further comprising:

a higher-level control loop for closed-loop control of the reduced pressure in the reduced-pressure production and mixing device; and a lower-level control loop for closed-loop control of at least one of pump rotation speed and speed of a valve in the propulsion water flow, in order to produce a reduced pressure.

17. The device as claimed in claim 15, further comprising a closed-loop control system including a PID regulator.

18. The device as claimed in claim 16, further comprising a computation unit for calculating an instantaneous reduced pressure in the reduced-pressure production and mixing device.

19. The device as claimed in claim 15, further comprising a computation device for determining an outlet pressure of the gas-water mixture that is formed.

20. The device as claimed in claim 15, further comprising a controllable propulsion water pump.

21. The device as claimed in claim 15, further comprising a control valve for a propulsion water in the propulsion system, to produce a reduced pressure.

22. The device as claimed in claim 15, further comprising a nozzle, whose cross section is adapted, to produce a reduced pressure.

23. The device as claimed in claim 15, further comprising a compressed-air unit for an amount of air which is required to blow the reduced-pressure production and mixing device free.

24. The device as claimed in claim 15, further comprising pressure sensors.

25. A method, comprising:

using the device in accordance to claim 15 in a surface vessel including an exhaust gas output line from a power generating device substantially below the waterline.

26. A method, comprising:

using the device in accordance to claim 15 for an exhaust gas line from a power generating device in an area of an outer hull of at least one of a stern end and behind a sail of the submarine.

27. The method as claimed in claim 26, wherein the device for reduced-pressure production and mixing device is arranged at least one of in a foot and at a foot of a submarine sail.

28. A method, comprising:

using the device in accordance to claim 15 in conjunction with a deeply submerged waterjet.

29. A method, comprising:

using the device in accordance to claim 15 to increase power of turbocharged diesel engines.

30. The submarine as claimed in claim 8, wherein the reduced pressure is set in order to achieve a maximum possible power from the at least one charging diesel.

31. The submarine as claimed in claim 3, wherein the reduced-pressure production and mixing device is shut down in a stopping sequence in conjunction with the at least one charging diesel open-loop and closed-loop control.

32. The submarine as claimed in claim 31, further comprising a computation unit for at least one of a starting sequence and a stopping sequence, the computation unit being connected to at least one of a general submarine automation device and a propulsion system of the submarine.

33. The device as claimed in claim 15, wherein an electrical connection is used to transmit control variables and input values to the automation system.

34. The device as claimed in claim 33, wherein the electrical connection is used to transmit control variables and input values to a part of the automation system which is used for open-loop and closed-loop control of the charging diesel.

35. The device as claimed in claim 24, wherein the pressure sensors include pressure sensors for a water pressure on the submarine, and a pressure sensor for an exhaust gas pressure of the exhaust gases.

* * * * *